US009266133B2

(12) United States Patent
Fyke et al.

(10) Patent No.: US 9,266,133 B2
(45) Date of Patent: Feb. 23, 2016

(54) SPRAY BOTTLES WITH FLEXIBLE BODY PORTIONS AND SOFT REFILL CONTAINERS

(71) Applicant: L&F Innoventions, LLC, Naples, FL (US)

(72) Inventors: Tyler W. Fyke, Naples, FL (US); Paul Bradley Forrest, Cary, NC (US); Bryan McNelis, Irvine, CA (US); Thomas Perelli, Raleigh, NC (US)

(73) Assignee: L&F Innoventions, LLC, Naples, FL (US)

( * ) Notice: Subject to any disclaimer, the term of this patent is extended or adjusted under 35 U.S.C. 154(b) by 90 days.

(21) Appl. No.: 13/925,260

(22) Filed: Jun. 24, 2013

(65) Prior Publication Data

US 2013/0341357 A1 Dec. 26, 2013

Related U.S. Application Data

(60) Provisional application No. 61/663,051, filed on Jun. 22, 2012.

(51) Int. Cl.
*B67D 7/58* (2010.01)
*B05B 11/00* (2006.01)
(Continued)

(52) U.S. Cl.
CPC ..... *B05B 11/0097* (2013.01); *A47L 13/22* (2013.01); *B05B 11/0037* (2013.01); *B05B 11/0056* (2013.01); *B05B 11/3057* (2013.01); *B05B 15/061* (2013.01); *B05B 15/065* (2013.01);
(Continued)

(58) Field of Classification Search
CPC ..... B05B 11/0037; B05B 11/3052–11/3057; B65D 90/027; B65D 5/4212; B65D 5/02; B65D 5/36; B65D 5/3621; B65D 5/42; B65D 5/422; B65D 4/4266; B65D 5/76; B65D 81/3876; B65D 2081/008; B65D 2203/00–2203/08
USPC ..... 222/383.1, 383.3, 105–107, 183, 173, 222/464.1–464.7, 382, 538–539, 530, 222/522–524, 630–637; 220/666, 669, 660, 220/737–739
See application file for complete search history.

(56) References Cited

U.S. PATENT DOCUMENTS 1,623,107 A * 4/1927 Goodykoontz ..... 222/107
2,363,148 A * 11/1944 Rosen ..... 222/633
(Continued)

OTHER PUBLICATIONS

Attach_Definition of attach by Merriam-Webster.pdf.*
(Continued)

*Primary Examiner* — Patrick M Buechner
*Assistant Examiner* — Randall Gruby
(74) *Attorney, Agent, or Firm* — NK Patent Law, PLLC

(57) ABSTRACT

A vessel defining a variable interior volume has a wall with a first and second wall portion, and a flexure zone parallel to a longitudinal axis. In a volumetrically reduced configuration, the wall portions are brought together by flexing of the flexure zone. A fixing element attached to the wall releasably maintains the wall in the reduced configuration by maintaining proximity of the wall portions. A spray bottle system includes a housing forming a receptacle for receiving a soft refill liquid container and having at least one opening representing a reduction in material of the housing. A spray head includes an operable trigger for causing dispensation of liquid from the container. A pivoting junction connects the housing to the spray head permitting flexing of the spray head.

10 Claims, 16 Drawing Sheets

(51) Int. Cl.

| | |
|---|---|
| ***B67D 7/02*** | (2010.01) |
| ***B65D 81/22*** | (2006.01) |
| ***B65D 1/40*** | (2006.01) |
| ***B65D 90/02*** | (2006.01) |
| ***B65D 1/06*** | (2006.01) |
| ***B05B 15/06*** | (2006.01) |
| ***A47L 13/22*** | (2006.01) |
| *B05B 15/00* | (2006.01) |

(52) U.S. Cl.
CPC .. *B65D 1/06* (2013.01); *B65D 1/40* (2013.01); *B65D 81/22* (2013.01); *B65D 90/027* (2013.01); *B67D 7/0288* (2013.01); *B05B 15/005* (2013.01)

(56) References Cited

U.S. PATENT DOCUMENTS 2,685,316 A * 8/1954 Krasno ..... 206/524.8
3,288,334 A * 11/1966 Corsette ..... 222/107
3,367,380 A * 2/1968 Dickey ..... B65D 37/00 222/107
3,559,847 A * 2/1971 Goodrich ..... B65D 37/00 222/107
3,595,441 A * 7/1971 Grosjean ..... B65D 1/0292 222/107
3,898,945 A * 8/1975 Rohowetz ..... B21D 51/2676 156/218
3,926,341 A 12/1975 Lhoest
4,035,004 A 7/1977 Hengesbach
4,044,836 A * 8/1977 Martin ..... B05B 11/041 169/30
4,146,133 A * 3/1979 Bogorad ..... B65D 33/002 206/439
4,157,103 A * 6/1979 La Fleur ..... B65D 1/0292 141/338
4,193,518 A * 3/1980 Holmes ..... 222/105
4,256,154 A 3/1981 Black
4,265,374 A * 5/1981 Sebalos ..... 222/95
4,456,134 A * 6/1984 Cooper ..... B65D 1/0292 215/12.1
4,492,313 A * 1/1985 Touzani ..... B65D 1/0292 215/372
4,526,280 A * 7/1985 Taylor ..... B65D 77/0406 150/154
4,558,821 A 12/1985 Tada et al.
4,618,076 A 10/1986 Silvenis
4,686,814 A * 8/1987 Yanase ..... B65D 33/20 383/35
4,705,191 A 11/1987 Itzel et al.
4,781,311 A 11/1988 Dunning et al.
4,790,361 A * 12/1988 Jones ..... B65D 1/0292 215/12.1
4,830,235 A 5/1989 Miller
4,850,509 A * 7/1989 Hollenberg ..... B65D 5/3607 206/205
4,865,211 A * 9/1989 Hollingsworth ..... 220/8
4,867,374 A * 9/1989 Murray ..... B65D 5/36 229/104
4,925,066 A 5/1990 Rosenbaum
5,031,798 A 7/1991 Wild
5,056,685 A 10/1991 Wild
5,083,678 A 1/1992 Waring
5,114,011 A * 5/1992 Robbins, III ..... B29C 53/08 206/219
5,152,431 A 10/1992 Gardner et al.
5,156,295 A 10/1992 Gordon et al.
5,156,299 A 10/1992 De Caluwe et al.
5,160,071 A 11/1992 Wright
5,174,458 A 12/1992 Segati
5,195,664 A 3/1993 Rhea
5,206,037 A * 4/1993 Robbins, III ..... B29C 53/08 264/295
5,226,551 A * 7/1993 Robbins, III ..... A61G 9/006 215/13.1
5,240,130 A * 8/1993 Osbakk ..... 215/12.1
5,244,125 A 9/1993 Robbins, III
5,251,820 A 10/1993 Ho
5,299,700 A * 4/1994 Beniacar ..... 215/12.1
5,328,055 A 7/1994 Battle
5,337,921 A 8/1994 Wilson et al.
5,370,250 A * 12/1994 Gilbert ..... 222/1
5,398,846 A 3/1995 Corba et al.
5,421,485 A 6/1995 Furuta et al.
5,429,254 A 7/1995 Christine
5,435,464 A * 7/1995 Alexander et al. ..... 222/105
5,439,141 A 8/1995 Clark et al.
5,464,129 A * 11/1995 Ho ..... 222/377
5,472,119 A 12/1995 Park et al.
5,474,212 A 12/1995 Ichikawa et al.
5,478,015 A 12/1995 Black
5,542,581 A 8/1996 Habora et al.
5,558,257 A 9/1996 Braun
5,615,791 A * 4/1997 Vatelot et al. ..... 215/382
5,642,826 A * 7/1997 Melrose ..... 215/382
5,711,445 A * 1/1998 Robbins, III ..... A47G 23/0241 215/384
5,718,383 A 2/1998 Smith et al.
5,836,479 A 11/1998 Klima et al.
5,839,616 A 11/1998 Irwin et al.
5,871,122 A 2/1999 Klima et al.
5,890,624 A 4/1999 Klima et al.
5,934,519 A 8/1999 Kim et al.
5,944,223 A 8/1999 Klima et al.
5,947,332 A 9/1999 Klima, Jr. et al.
5,979,715 A 11/1999 Emrick
5,984,199 A 11/1999 Restive
6,027,041 A 2/2000 Evans
6,059,152 A 5/2000 Mayfield
6,123,230 A 9/2000 Klima, Jr. et al.
6,179,142 B1 1/2001 Hansen
6,206,243 B1 3/2001 Schneider et al.
6,213,358 B1 4/2001 Libit et al.
6,250,511 B1 6/2001 Kelly
6,253,993 B1 7/2001 Lloyd et al.
6,319,453 B1 11/2001 Klima, Jr. et al.
6,345,774 B1 2/2002 Calhoun
6,394,319 B1 5/2002 Pucillo
6,409,103 B1 6/2002 Norville et al.
6,510,965 B1 * 1/2003 Decottignies et al. ..... 222/95
6,530,108 B1 3/2003 Brown et al.
6,540,109 B1 4/2003 Klima et al.
6,631,830 B2 10/2003 Ma et al.
6,659,670 B1 12/2003 Blouse
6,732,958 B2 5/2004 Norville et al.
6,789,303 B2 9/2004 Maas et al.
6,833,072 B1 12/2004 Krestine et al.
6,834,815 B2 12/2004 Appleby
7,040,510 B1 5/2006 Hester
7,251,839 B2 8/2007 Bell
7,478,738 B2 1/2009 Hood et al.
7,513,378 B2 * 4/2009 Mori et al. ..... 215/381
7,520,447 B2 4/2009 Engelen et al.
7,581,273 B2 9/2009 Dobrin et al.
7,648,083 B2 1/2010 Hornsby et al.
7,717,306 B2 5/2010 White, Sr.
8,157,131 B2 4/2012 Sim
8,215,509 B2 * 7/2012 Kuboi et al. ..... 215/381
8,534,478 B2 * 9/2013 Mays, III ..... B65D 21/0231 215/381
2001/0011661 A1 8/2001 Klima et al.
2002/0031625 A1 3/2002 Klima, Jr. et al.
2002/0070244 A1 * 6/2002 Simard ..... 222/382
2003/0038186 A1 2/2003 Klima et al.
2003/0066843 A1 * 4/2003 Schwartz ..... 222/377
2004/0035819 A1 2/2004 Dennison
2004/0104194 A1 6/2004 Dennison
2004/0245208 A1 12/2004 Dennison
2005/0167442 A1 8/2005 Cuisinier
2006/0143847 A1 7/2006 Vinson et al.
2006/0237485 A1 10/2006 An
2007/0086683 A1 * 4/2007 Yeager ..... 383/95
2007/0215645 A1 9/2007 Clynes et al.
2007/0235472 A1 10/2007 McFarland

(56) References Cited

U.S. PATENT DOCUMENTS

| | | | | |
|---|---|---|---|---|
| 2008/0011779 | A1 | 1/2008 | Klima et al. | |
| 2008/0023499 | A1* | 1/2008 | Knight | 222/464.7 |
| 2008/0279611 | A1 | 11/2008 | Graphenius | |
| 2008/0315018 | A1 | 12/2008 | Withers | |
| 2009/0212077 | A1 | 8/2009 | Carden | |
| 2009/0277928 | A1 | 11/2009 | Bruckner | |
| 2010/0096414 | A1 | 4/2010 | Dennis | |
| 2010/0096415 | A1 | 4/2010 | Dennis | |
| 2010/0252573 | A1* | 10/2010 | Hetmaniok et al. | 222/105 |
| 2011/0062185 | A1 | 3/2011 | McFarland | |
| 2011/0120992 | A1* | 5/2011 | Gorman et al. | 219/727 |
| 2011/0121039 | A1 | 5/2011 | Dennis | |
| 2011/0158740 | A1 | 6/2011 | Kandasamy et al. | |
| 2011/0180101 | A1 | 7/2011 | Konishi et al. | |
| 2011/0180619 | A1 | 7/2011 | Konishi et al. | |
| 2012/0097707 | A1* | 4/2012 | Taberlet | 222/105 |
| 2014/0346252 | A1* | 11/2014 | Davis | 239/328 |

OTHER PUBLICATIONS

Non-final Office Action mailed Jun. 26, 2013 for U.S. Appl. No. 12/895,982.

* cited by examiner

SPRAY BOTTLES WITH FLEXIBLE BODY PORTIONS AND SOFT REFILL CONTAINERS

CROSS-REFERENCE TO RELATED APPLICATION

This patent application claims the benefit of priority of U.S. Provisional Patent Application No. 61/663,051, filed on Jun. 22, 2012, and entitled "Spray Bottle Apparatuses and Associated Accessories." The above-referenced provisional patent application is incorporated herein in entirety by this reference.

TECHNICAL FIELD

This disclosure relates generally to janitorial-related products and services, and more particularly to vessels having volumetrically reduced and expanded configurations, and spray bottle systems having hinging spray heads.

BACKGROUND

Conventional spray bottles for cleaning and other dispensation purposes typically have rigid bodies that are inflexible and bulky in use and represent needless material wastes. Many are not designed for refilling and reuse. Thus, bulky rigid plastic containers tend to be discarded after the use of cleaning solutions and other commercially available liquids that are distributed in amounts as small as 6 ounces. The material wastes in the current cleaning solution economy ultimately take up space in waste disposal trucks which make many trips to landfills where one-time use containers take up space for many years.

Where refill provisions are made by manufacturers, the provisions typically amount to super-sized rigid-body containers used to refill conventional hand-held spray bottles, in which case it is unclear whether one large container is beneficial over many small containers when full environmental impact is considered.

Even when the disposal of currently available spray bottles is set aside as a concern, rigid-body spray bottles with rigidly fixed spray heads are difficult to use in tight spaces such as refrigerators, cabinets, and other spaces in homes and businesses where cleaning is needed. Difficulty particularly arises as the liquid contained in a typical spray bottle is almost depleted, in which case dispensation can typically only continue with the entire bottle and spray head assembly held in a true vertical orientation, despite whether such orientation directs any dispensed solution as needed currently by a user. In such a scenario, it is all too likely that a spray bottle will be discarded containing a significant amount of solution. Thus, the environmental impacts of disposal of both the container and remaining liquid contained are heightened by the inflexible liquid product packaging examples currently on store shelves.

SUMMARY

This Summary is provided to introduce a selection of concepts in a simplified form that are further described below in the Detailed Descriptions. This Summary is not intended to identify key features or essential features of the claimed subject matter, nor is it to be construed as limiting the scope of the claimed subject matter.

According to at least one embodiment, a vessel includes a wall surrounding a longitudinal axis and defines a variable interior volume. The wall has a first wall portion, a second wall portion, and a flexure zone parallel to the longitudinal axis between the first wall portion and the second wall portion. The wall has a volumetrically expanded configuration and a volumetrically reduced configuration in which the first wall portion and the second portion are brought together relative to the expanded configuration by flexing of the flexure zone. At least one fixing element is attached to the wall and is able to releasably maintain the wall in the reduced configuration by releasably maintaining proximity of at least two portions of the wall.

The vessel may contain a soluble product within the interior volume in a concentrated form. The soluble product may be prescribed for use in a diluted form by addition of a solvent to approximately fill the interior volume in the expanded configuration. In at least one example, and area of indicia hidden from view in the reduced configuration is exposed for view in the expanded configuration.

In at least one example, the flexure zone includes a crease around which the first wall portion and second wall portion are folded toward each other in the reduced configuration relative to the expanded configuration. The first wall portion and the second wall portion may form a flap releasably maintained as overlapping a neighboring portion of the wall by the fixing element. The fixing element may include a dry adhesive. In at least one example, the flap and an overlapped neighboring portion of the wall form a Z-fold in the reduced configuration. The wall may assume a coiled configuration in the reduced configuration, with at least one portion circumferentially overlapping another portion.

In at least one example, a flexible fluid impermeable pouch at least partially within the interior volume of the wall has an internal reservoir space for containing a liquid. A spray head connected to the pouch has an operable trigger, the actuation of which causes dispensation of liquid from the internal reservoir space. A tube may be included as having a first end connected to the spray head and a second end attached to the base of the pouch to maintain fluid connection of the tube with the liquid in the internal reservoir space. A flange may be connected to the pouch, the flange having a first opening for filling the internal reservoir space and a second opening connecting the tube. A removable or breakable closure may be attached to the flange sealing the first opening and second opening.

According to at least one embodiment, a spray bottle system includes a major housing, a flexible fluid impermeable soft refill container, a spray head, and a pivoting junction connecting the major housing to the spray head permitting flexing of the spray head relative to the major housing. The major housing defines a receptacle for receiving a soft refill container. The major housing has at least one opening representing a reduction in material of the major housing. The flexible fluid impermeable soft refill container defines an internal reservoir space for containing a liquid. The spray head is configured for fluid connection to the internal reservoir space of the soft refill container. The spray head includes an operable trigger for causing dispensation of liquid from the internal reservoir space.

In at least one example, the major housing includes a skeletal cage defining the receptacle and a skeletal gate hingedly attached to the skeletal cage for capturing the soft refill container within the receptacle upon closure of the skeletal gate.

In at least one example, the flexible fluid impermeable soft refill liquid container includes a flange having a first opening for filling of the internal reservoir space and a second opening for dispensation of liquid from the internal reservoir space. The tube has a first end connected to the flange in fluid connection with the second opening, and a second end extending into the internal reservoir space. Upon connection of the spray head to the flange and actuation of the operable trigger, liquid from the internal reservoir space is drawn through the tube and dispensed from the spray head. A removable or breakable closure may be attached to the flange sealing the first opening and second opening.

In at least one example, the pivoting junction includes a lock-and-release dial permitting manual locking and pivoting of the spray head about the pivoting junction. The lock-and-release dial may operate through a slipping mechanism that prevents manual over-tightening of the dial. In at least one example, the major housing includes a lower annular base and a circumferential wall above the base, the pivoting junction includes a shoulder connecting an upper margin of the circumferential wall to a lower margin of an upper neck to which the spray head is connected, and the shoulder, according to the opening representing a reduction in material, only partially materially encircles the upper portion of the circumferential wall.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed.

DETAILED DESCRIPTIONS

While the disclosure of the technology herein is presented with sufficient details to enable one skilled in this art to practice the invention, it is not intended to limit the scope of the disclosed technology. The inventor(s) contemplate that future technologies may facilitate additional embodiments of the presently disclosed subject matter as claimed herein. Moreover, although the term "step" may be used herein to connote different aspects of methods employed, the term should not be interpreted as implying any particular order among or between various steps herein disclosed unless and except when the order of individual steps is explicitly described.

Figure 1A:
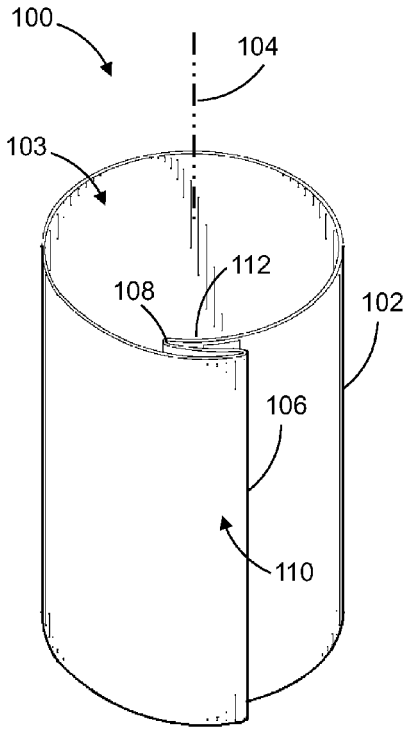
FIG. 1A is a perspective view of an expandable vessel, according to at least one embodiment, in a reduced configuration.
Figure 1B:
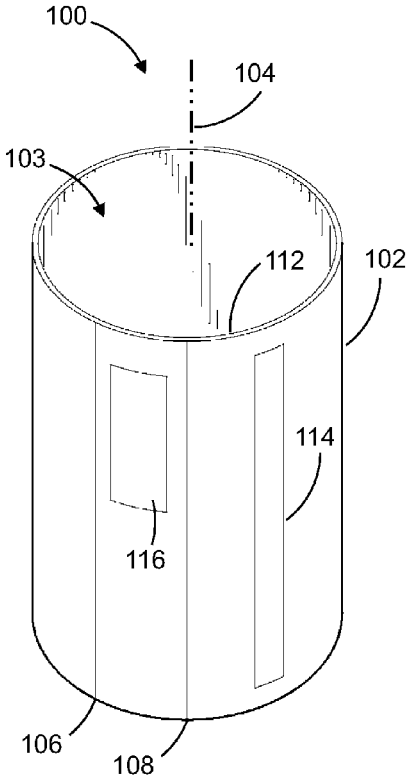
FIG. 1B is a perspective view of the expandable vessel of FIG. 1A in an expanded configuration.

A vessel 100 according to at least one embodiment is represented in a reduced configuration in FIG. 1A, from which the vessel is expandable to an expanded configuration as shown in FIG. 1B. The vessel 100 includes a semi-rigid exterior closed wall 102 that assumes, in the illustrated embodiment, an approximately circular cylindrical form in the expanded configuration with the wall 102 circumferentially surrounding a longitudinal axis 104 to define an interior volume 103. The wall 102 can be constructed of a material, such as plastic or paperboard coated with plastic such as polyethylene, sufficiently rigid vessel 100 to be self-standing and sufficiently flexible and durable to permit transitions, optionally multiple repeated transitions, between the volumetrically reduced configuration (FIG. 1A) and volumetrically expanded configuration (FIG. 1B). Monolayer or polylayer films and sheets may be used to construct the wall 102.

It should be noted that a closed wall 102 peripherally surrounding a longitudinal axis 104 to form a cylindrical vessel 100 according to these descriptions need not assume a circular cylindrical form. A cylindrical form can have planar, polygonal, arcuate, and semicircular portions, drawing on an understanding of a cylindrical form according to movement parallel to a linear axis of a closed trace around the linear axis, where the closed trace can have any combination of linear segments and arcuate curves.

The exterior wall 102 includes at least two flexible fold lines, creases 106 and 108, or other flexure zones parallel to the longitudinal axis. As shown in FIG. 1A, the creases 106 and 108 are folded oppositely each other, with one crease 106 forming an exterior flap margin and the other crease 108 forming an interior channel margin such that a flap 110 is formed and can be laid circumferentially along and overlapping a neighboring wall portion 112 of the wall 102 in the reduced configuration. The flap 110 is formed by bringing together two adjacent portions of the wall 102 on opposing sides of the crease 106. In the reduced configuration, the flap 110 and the neighboring wall portion 112 in the reduced configuration of FIG. 1A can be described as forming a Z-fold, and the exterior wall can be described as assuming a coiled configuration with at least one portion circumferentially overlapping another portion.

The wall 102 in the reduced configuration of FIG. 1A assumes an approximately circular cylindrical form having a reduced radius and a reduced circumference relative to the cylindrical form of expanded configuration of FIG. 1B. Accordingly, the internal volume of the vessel 100 in the reduced configuration of FIG. 1A is reduced relative to the internal volume of the vessel in the expanded configuration of FIG. 1B, where internal volume is defined between opposing longitudinal ends of the vessel 100, which may be considered as the top and bottom of the vessel when the longitudinal axis 104 is held as vertical. By selection of the total circumference of the wall 102, the length or height of the wall as measured between opposing longitudinal ends, and the placements of the creases 106 and 108, the volume of the vessel 100 in the reduced form (FIG. 1A) and the volume of the vessel in the expanded form (FIG. 1B) can be selected.

As shown in FIG. 1B, a releasable strip 114 (FIG. 2A) of adhesive or other fixing element is attached to the neighboring wall portion 112 of the wall 102 to releasably retain the vessel in the reduced configuration by maintaining the flap 110 (FIG. 1A) in the overlapped position against the neighboring wall portion 112. The releasable strip is broken or otherwise released to permit transition of the vessel from the reduced form (FIG. 1A) to the expanded form (FIG. 1B). In at least one embodiment, the releasable strip 114 is a dry adhesive broken when transition is wanted by a user. In such an example, the releasable strip 114 may provide a one-time-release bond that maintains the vessel in a reduced configuration prior to first use by a consumer or other end user. In such use, a dry adhesive material having low or no tackiness upon breaking of the bond may be preferred to avoid unsightly accumulation of contaminants. If a resealable or reusable bond is preferred, a multi-use adhesive such as a pressure-sensitive adhesive material may be used in or as the releasable strip 114. A second strip opposing the releasable strip 114 may be provided. For example, hook and loop strips may be used to provide a multi-use bond to facilitate repeated returns to a reduced vessel configuration from multiple instances of use in an expanded vessel configuration.

In at least one embodiment according to these descriptions, the vessel 100 defines a product container having a product in relatively high concentration as provided in the reduced form (FIG. 1A). A consumer or other user can reduce the product to a lower concentration by expanding the vessel to expanded form (FIG. 1B) and filling the space made available within the vessel by the expansion with a solvent such as water. For example, a concentrated cleaning solution can be provided as filling or otherwise occupying the vessel 100 in the reduced form (FIG. 1A). In that example, the cleaning solution concentration can be reduced to a predetermined level for use upon dilution of the cleaning solution by addition of water to fill the vessel in the expanded form (FIG. 1B). Thus, the vessel 100 defines a fault-proof product container for any soluble product in concentrated form such as a concentrated solution, powder, or other solid with regard to dilution to a prescribed lower concentration by an end user. A prescribed dilution can be conducted without requiring the use of additional measuring devices such as measuring cups and graduated cylinders, which may not always be readily available or may be deemed as inconvenient.

Because the volume of a circular cylinder varies by the square of the radius, considerable volume expansion can be provided by transitioning the vessel 100 from the reduced form (FIG. 1A) to the expanded form (FIG. 1B). In one example, approximately 8 ounces of a product in a concentrated form occupies the vessel 100 in the reduced form (FIG. 1A), whereas approximately 32 ounces of the product in a desired diluted form occupies the vessel in expanded form (FIG. 1B) after addition of water or other solvent. In that example, the radius of the vessel 100 in the expanded form (FIG. 1B) is approximately twice the radius of the vessel in the reduced form (FIG. 1A). Such an example can relate to a concentrated cleaning product such as a detergent provided in a concentrated liquid, powder, solid or gelatinous form. Such an example can relate to a concentrated food or beverage product such as a soup, milk or juice provided in a concentrated liquid, powder, solid or gelatinous form. Many additional uses and examples will likely be contemplated in view of these descriptions.

Indicia 116 including text and/or graphics may be included along the wall 102 as represented in FIG. 1B. As shown, the indicia 116 can be placed along the neighboring wall portion 112, which is overlapped by the flap 110 in the reduced configuration of FIG. 1A. By placement as illustrated, or by placement along another portion of a fold hidden in the reduced configuration and exposed in the expanded configuration, viewing of the indicia 116 can be selectively made available in an expanded configuration but hidden in a reduced configuration. Product information such as use or preparation instructions, warranties, warnings and disclaimers, and cross-product advertising can thus be hidden when the vessel is provided, for example on retail shelves, in the reduced configuration of FIG. 1A and then come into view upon transition to an expanded configuration (FIG. 1B). Indicia including text and/or graphics may furthermore be applied to any other portion of the vessel 100.

The vessel 100 in various embodiments includes various closure and sealing structures at the longitudinal ends for forming a closed, closeable, or partially closed vessel 100 with the wall 102. For example, an expandable diaphragm may be attached to each longitudinal end to form closures that vary to accommodate the reduced (FIG. 1A) and expanded (FIG. 1B) configurations of the vessel 100. Flexible films or layered materials may be used as base and cap closures which may be gusseted or otherwise creased or folded to accommodate transitions from reduced to expanded configurations and back.

Figure 2A:
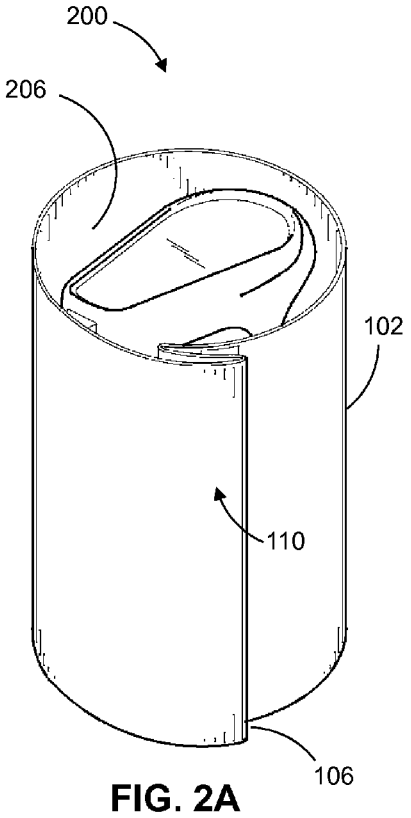
FIG. 2A is a perspective view of a spray bottle, according to at least one embodiment, in a reduced configuration.
Figure 2B:
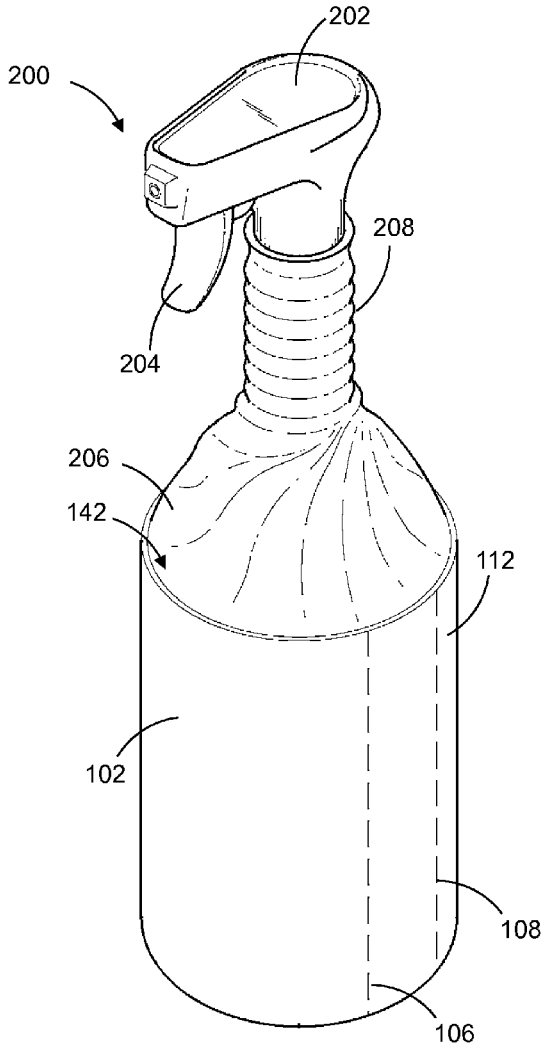
FIG. 2B is a perspective view of the spray bottle of FIG. 2A in an expanded configuration.

A particular containment vessel 200 shown in FIGS. 2A-2B includes the semi-rigid exterior wall 102 and optionally includes by reference features from the above descriptions with regard to FIGS. 1A-1B. In the particularly illustrated embodiment, the vessel 200 defines a fluid containment and dispensation spray bottle. The spray bottle 200 includes a hand-held spray head 202, an operable trigger 204, and an internal reservoir space 142 defined within the wall 102 by a flexible fluid impermeable pouch or bag 206. Actuation of the operable trigger 204 causes dispensation of fluid within the internal reservoir space through the spray head 202, for example by way of an internal straw or tube. The flexible pouch 206 gathers from the top margin of the wall 102 to the spray head 202. In the reduced configuration of the fluid containment and dispensation spray bottle 200 (FIG. 2A), the spray head 202 is stowed downward into the cylindrical space defined by the wall 102 with adjacent marginal portions of the pouch gathered, folded, or bunched in a collapsed form. In the expanded configuration of the fluid containment and dispensation spray bottle 200 (FIG. 2B), the spray head 202 is deployed above the cylindrical space defined by the wall 102 with adjacent marginal portions of the pouch in an unfolded, puffed or otherwise expanded form.

The internal reservoir space 142 can be filled or refilled by removing the spray head 202 from the neck of the spray bottle and filling the internal reservoir through the neck 208 of the container housing. The spray head 202 is mounted to the neck, for example, by a threaded collar or other releasable sealing structure. A cap, frangible seal, or other reusable closure or one-time breakable closure may be provided at the top of the neck 208 to seal the pouch 206, for example to store contained liquid when spraying capability is not needed. Such a closure may be preferred, for example, when the reduced form (FIG. 2A) is desired for storage or sale purposes without a spray head.

Figure 3A:
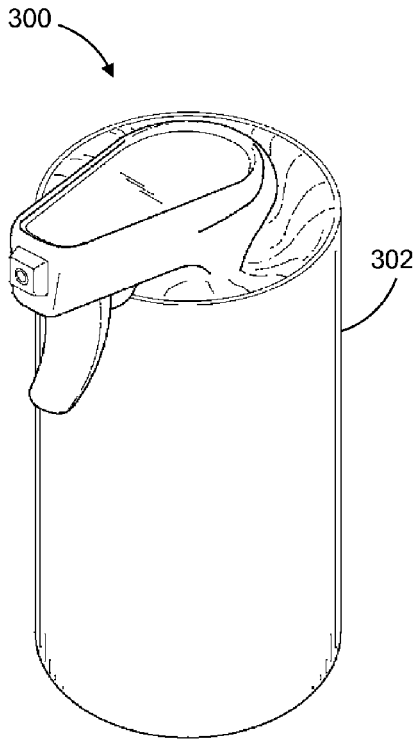
FIG. 3A is a perspective view of an expandable containment and dispensation vessel, according to at least one embodiment, in a reduced configuration.
Figure 3B:
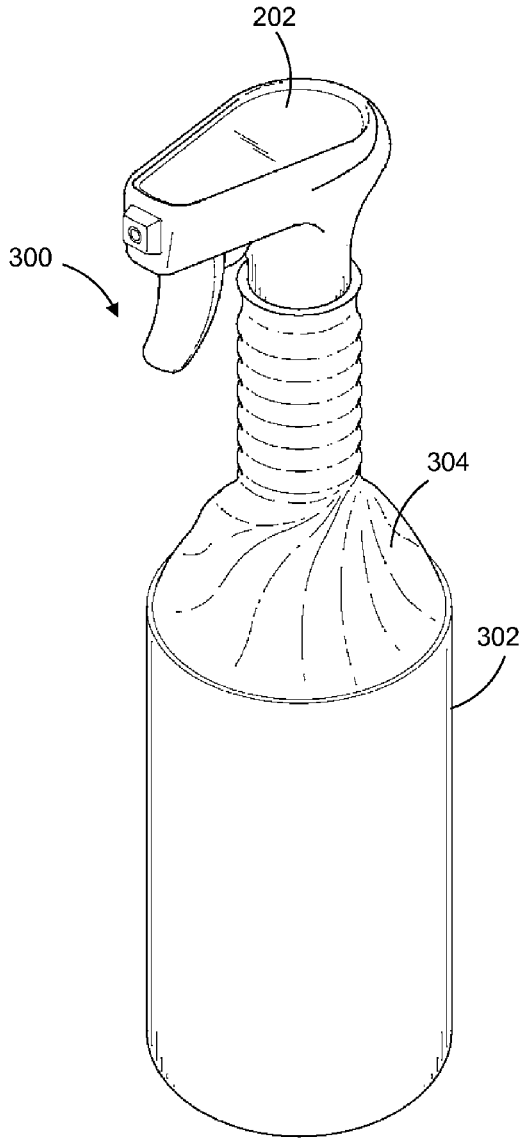
FIG. 3B is a perspective view of the vessel of FIG. 3A in an expanded configuration.

A particular containment and dispensation vessel 300 shown in FIGS. 3A-3B includes an exterior wall 302 and optionally includes by reference features from the above descriptions with regard to FIGS. 1A-1B and FIGS. 2A-2B. The wall 302 may be a cylindrical and rigid or semi-rigid wall free of creases and folds, or the wall 302 may be considered as similar to the wall 102 described above. The spray head 202 is connected to a flexible bellows 304 (FIG. 3A) that allows the spray head 202 to flex relative to other portions of the vessel 300 and also allows the spray head 202 to be stored with space efficiency by collapsing the bellows (FIG. 3B).

Figure 4A:
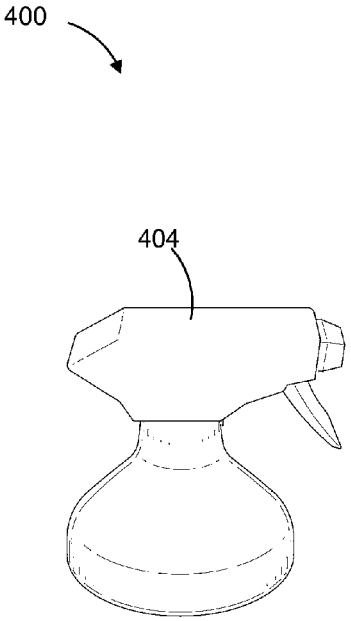
FIG. 4A is a perspective view of a spray head according to at least one embodiment.
Figure 4B:
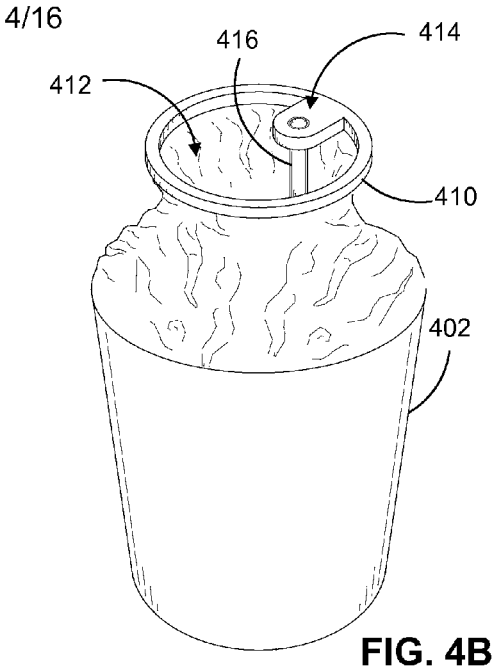
FIG. 4B is a perspective view of a containment and dispensation vessel according to at least one embodiment.
Figure 4C:
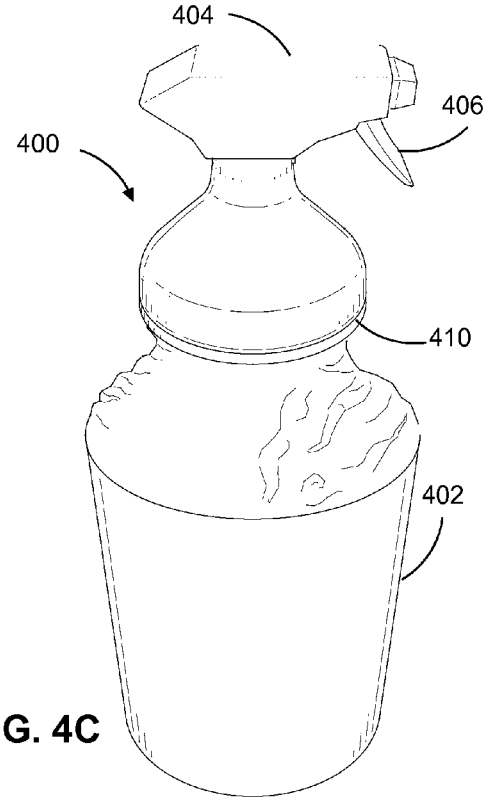
FIG. 4C is a perspective view of the spray head of FIG. 4A mounted on the vessel of FIG. 4B to form a spray bottle according to at least one embodiment.

A particular containment and dispensation vessel 400 shown in FIGS. 4A-4C includes an exterior wall 402 (FIGS. 4B-4C) and optionally includes by reference features from the above descriptions with regard to FIGS. 1A-1B and FIGS. 2A-2B. The wall 402 may be a cylindrical and rigid or semi-rigid wall free of creases and folds, or the wall 402 may be considered as similar to the wall 102 described above. A hand-held spray head 404 (FIG. 4A) includes an operable trigger 406 and an internal pump mechanism. A mounting flange 410 (FIG. 4B) for mounting the spray head 404 has two openings (FIG. 4B). The first opening 412 is for filling/refilling the vessel 400. The second opening 414 retains the uppermost end of a draw tube 416. When the spray head 404 is attached to the mounting flange 410 (FIG. 4C), the filling/refilling opening 412 is sealed and connection is established between draw tube 416 and the internal pump mechanism. Subsequent actuation of the operable trigger 406 causes dispensation of fluid within the vessel 400 through the spray head 404 by way of the draw tube 416.

Figure 5A:
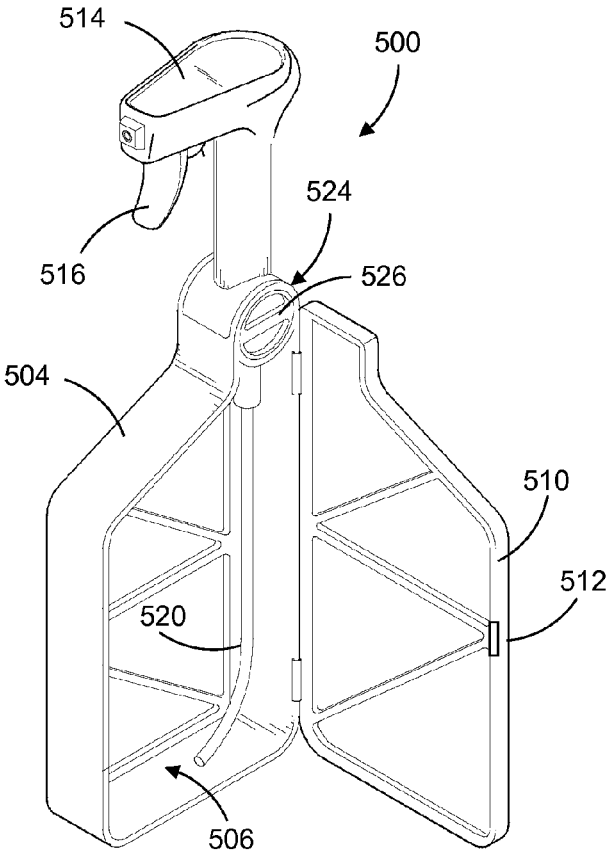
FIG. 5A is a perspective view of a spray bottle body having a skeletal housing according to at least one embodiment.

A spray bottle body 500 is shown in FIG. 5A and a soft refill container 502 for use with the spray bottle body 500 is shown in FIG. 5A. The spray bottle body 500 includes a skeletal housing 504 defining a receptacle cage 506 for receiving the soft refill container 502 and a skeletal gate 510 hingedly attached to the receptacle cage 506 for capturing the container 502 within the cage 506 upon closure of the gate 510. The receptacle cage 506 and skeletal gate 510 each have openings defined among structural members or portions, such that the openings represent a reduction in material in the overall form of the body 500. Such reduction in material saves in material costs in production and lowers waste material in the event of final disposal of the spray bottle body 500, which is otherwise intended for multiple uses and recycling at the end of its useful life.

Figure 5B:
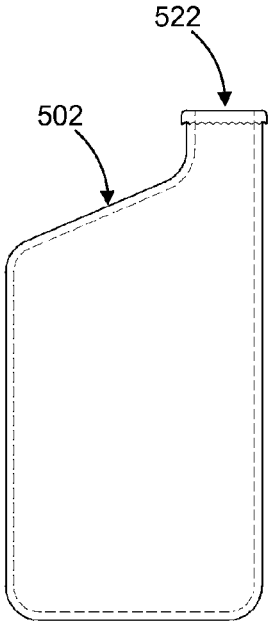
FIG. 5B is a soft refill container according to at least one embodiment, for example for use with the spray bottle body of FIG. 5A.

The gate 510 includes a clip 512 that retains the gate in a closed configuration once the clip snaps into engagement with the cage 506. The clip 512 is subsequently manually releasable by a user applying appropriate force to disengage the cage and open the gate 510 for replacement of the soft refill container 502. A hand-held spray head 514 (FIG. 5A) including an operable trigger 516 and draw tube 520 is mounted on the skeletal housing. To load the spray bottle body 500 (FIG. 5A) with the soft refill container 502 (FIG. 5B), the container 502 is placed into the receptacle cage 506 while feeding the draw tube 520 into the container after breaking a penetrable seal 522 using the free tip of the draw tube 520 or other sharp instrument. The gate 510 is then snapped into its closed position. Subsequent actuation of the operable trigger 516 causes dispensation of fluid within the container 502 through the spray head 514 by way of the draw tube 520. A threaded or otherwise removably engaged cap may be provided to protect the penetrable seal 522 when the container 502 is to be resealed, stored, or transported.

In the illustrated embodiment, the hand-held spray head 514 is pivotally attached to the skeletal housing 504 by a pivoting junction 524 to permit selectable orientation of the spray head 514. A lock-and-release dial 526 permits manual locking and pivoting of the spray head 514 about the pivoting junction 524. In one example, the lock-and-release dial 526 operates through a slipping mechanism that prevents manual over-tightening of the dial.

Various embodiments described herein represent individually and cumulatively "green" solutions for satisfying ecological responsibilities toward the environment by providing reusable spray bottle bodies and recyclable soft refill containers, by allowing options for consumers and other users to mix or dilute chemicals from concentrates, and by controlling waste. Soft refill containers can be provided by many manufacturers cooperating to offer standardized sealing structures and refill sizes so that a minimum number of standardized spray bottle components are used. For example, a user may purchase a single spray head, skeletal spray bottle body, or other standardized spray tool according to one or more embodiments described herein for use with multiple chemical products from multiple manufacturers. Skeletal and collapsible designs use minimal construction materials such as plastic.

Figure 6A:
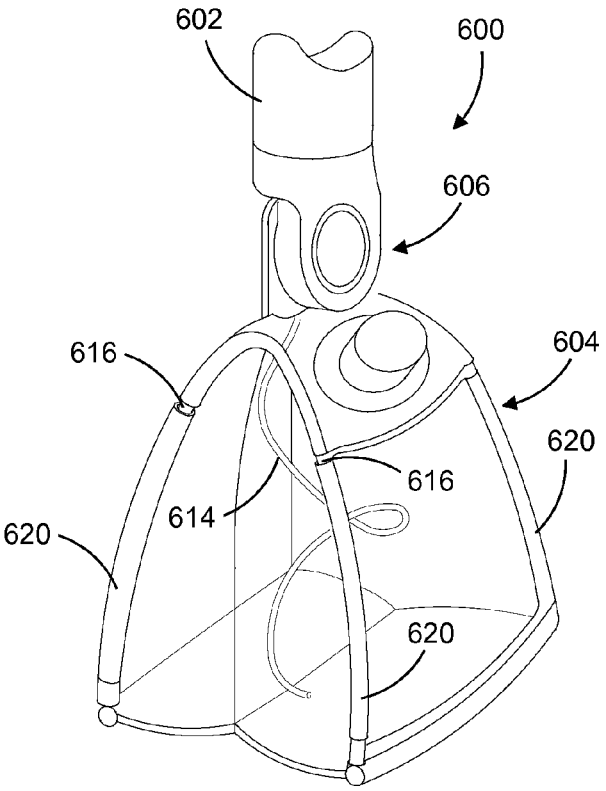
FIG. 6A is a perspective view of a vessel or collapsible material maintained in a free standing configuration by structural support members according to at least one embodiment.
Figure 6B:
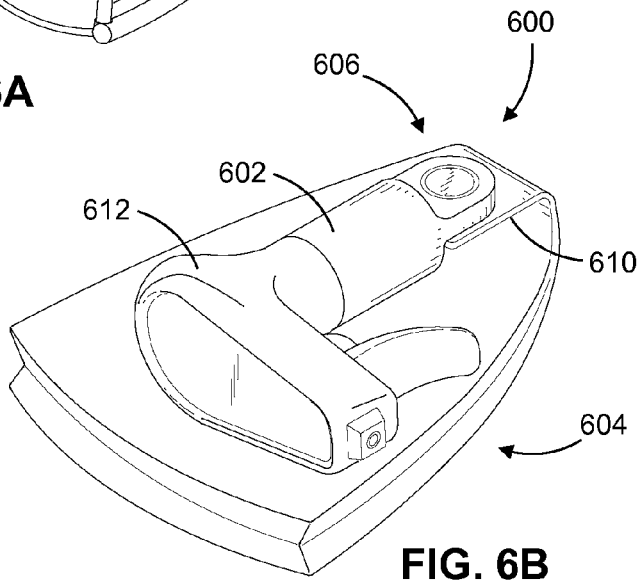
FIG. 6B is the vessel of FIG. 6A and an added spray head in a collapsed configuration.

In FIG. 6A, a storage and dispensation vessel 600 is constructed of a flexible, foldable, collapsible material. A neck 602 for mounting a dispensation device such as a spray head is attached to the collapsible reservoir housing 604 by a pivoting junction 606 to permit selectable orientation of the neck 602 about a first axis of rotation. Upper portions of the housing 604 are collapsible and foldable to form a tab 610 (FIG. 6B) that folds about a second axis perpendicular to the first axis. By pivoting of the junction 606 and flexure of the tab 610, a spray head 612 mounted on the neck 602 can be oriented in multiple directions relative to the housing 604. The housing 604 can be reduced to a relatively flat lying configuration (FIG. 6B) from an expanded configuration (FIG. 6A) in which predetermined folds are made about manufactured flexure zones. In the flat configuration (FIG. 6B), the tab 610 can be folded down to lay the neck 602 and spray head 612 against medial and lower portions of the housing 604 to assume a compact overall form factor as shown.

The pivoting junction 606 is sufficiently strong to bear the weight of the housing 604 when expanded and filled with liquid. A draw tube 614 establishes fluid connection from the interior of the housing 604 to the junction 606. A fluid channel transits the junction 606, even as the junction rotates, and establishes further connection from the draw tube 614 to the neck 602 such that, upon mounting of a dispensation device such as the spray head 612, fluid connection from the housing 604 to the mounted dispensation device is established. A releasable snap or threaded engagement connects a dispensation device such as the spray head 612 to the neck 602.

The housing 604 may be sufficiently rigid to define a free standing structure when in the expanded configuration (FIG. 6A). However, in at least one embodiment, the housing 604 is constructed of a thin monolayer or multilayer film of flexible material as a pouch supported by rigid or semi-rigid structural support members 616 inserted into channels 620 formed along, for example, exterior and marginal portions of the film. The channels may be formed of the same primary film as the pouch or may be formed by and outer layer of extra film or material strategically attached to the exterior of the primary film. In such examples, the channels 620 engage the support members 616 to form a free standing structure as shown in FIG. 6A in any state of fill or depletion of the housing with respect to internally stored liquid. In the illustrated example, the vessel 600 assumes a double-wish-bone or A-frame form between two spaced support members shaped as arches, each having a pair or arcuate legs extending downward, in the standing position of FIG. 6A, and a central raised apex supported by the legs.

As shown in FIG. 6A, a distal end of the draw tube 614 is attached to the inner surface of the floor plane of the flexible housing 604 to assure fluid connection with present liquid even when the vessel 600 is almost empty, folded, collapsed and/or deformed. The draw tube 614 is shown as having a helical form that can assume various effective lengths from the pivoting junction 606 to the floor plane as the configuration of the housing 604 varies.

In FIGS. 7A-7B, 8A-8B, 9A-9B, and 10A-10C, various embodiments of spray apparatuses are illustrated. A container frame 700 of unitary construction, for example blow molded and formed continuously of a single material such as plastic, includes a lower annular base 702, a circumferential wall 704 above the base, an upper neck 706 connected to a spray head housing 710, and a shoulder 712 connecting an upper margin of the circumferential wall 704 to a lower margin of the upper neck 706. An opening 714 is defined approximately level with the shoulder 712 relative to the base 702. By the opening 714 representing a reduction in material in the shoulder 712, which according to the opening 714 only partially materially encircles the upper portion of the circumferential wall 704, the shoulder 712 is flexible and permits hinging of the upper neck 706 relative to the circumferential wall 704 and base 702. Such reduction in material also saves in material costs in production and lowers waste material in the event of final disposal of the container frame, which is otherwise intended for multiple uses and recycling at the end of its useful life.

A mechanical pump mechanism 716 (FIG. 9A), for example constructed in part of injection molded components, is snapped into the spray head housing 710 to assemble a spray head 720 having a lower fluid connector 722, which is accessible through the opening 714 upon assembly of the spray head 720, and an operable trigger 724. To prepare these embodiments for use, a flexible, foldable, collapsible pouch 726 is placed into the interior area of the circumferential wall 704 through an opening 730 (FIG. 9B) defined in the lower annular base 702 with a fluid connector of the pouch 726 docked with the fluid connector 722 of the spray head 720. Subsequent actuation of the operable trigger 724, for example while grasping the upper neck as a handle, causes dispensation of liquid from the collapsible pouch 726 through a nozzle of the spray head 720.

Figure 7A:
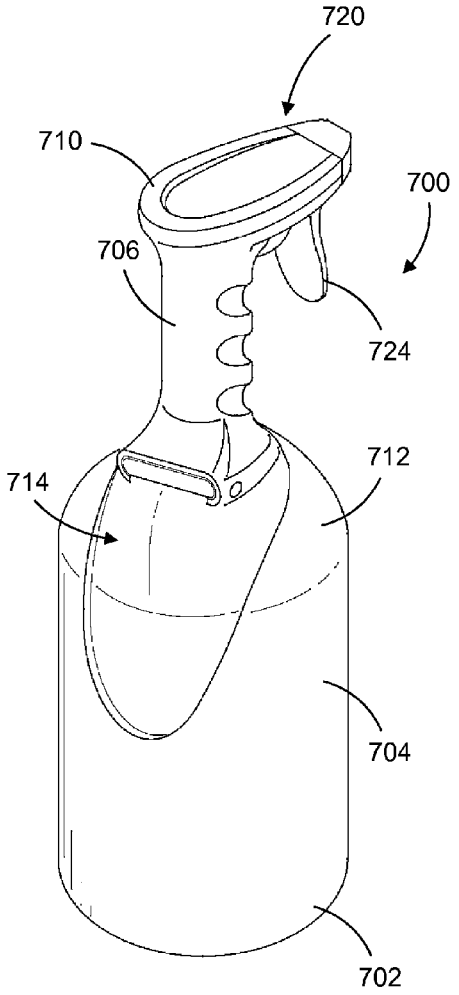
FIG. 7A is a perspective view of a spray apparatus according to at least one embodiment, in which a fluid-containing collapsible pouch is received by a container frame for dispensation of fluid through a spray head.
Figure 7B:
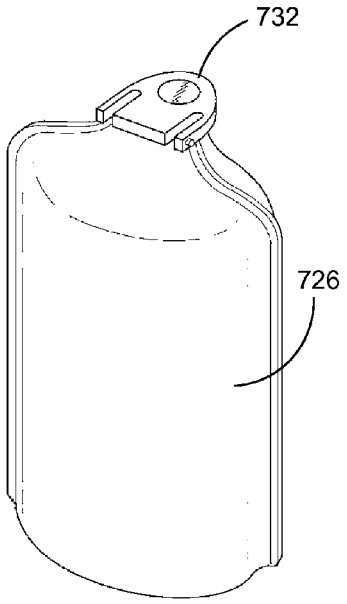
FIG. 7B is a perspective view of the collapsible pouch of FIG. 7A.
Figure 8A:
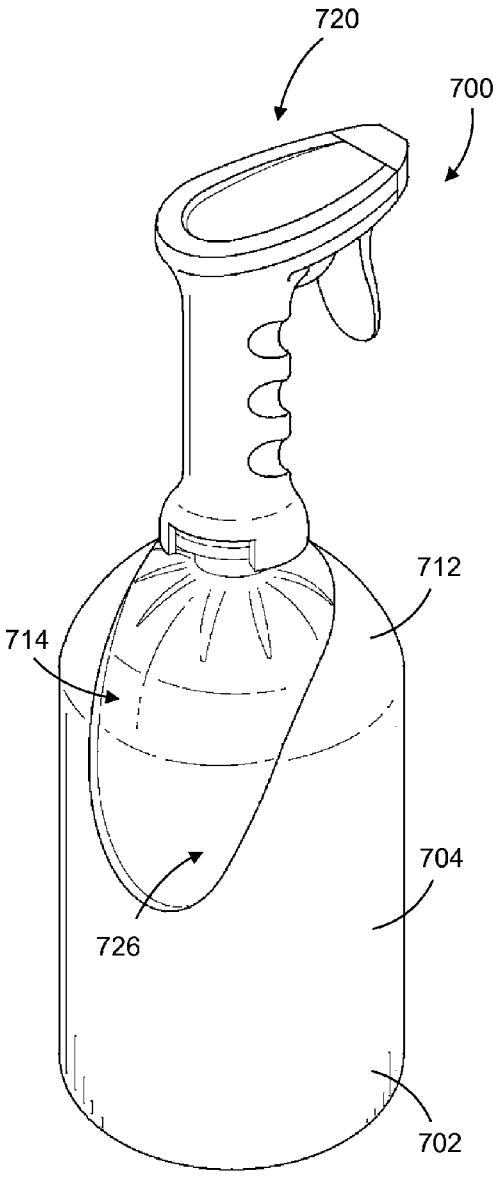
FIG. 8A is a perspective view of a spray apparatus according to at least one other embodiment, in which a fluid-containing collapsible pouch is received by a container frame for dispensation of fluid through a spray head.
Figure 8B:
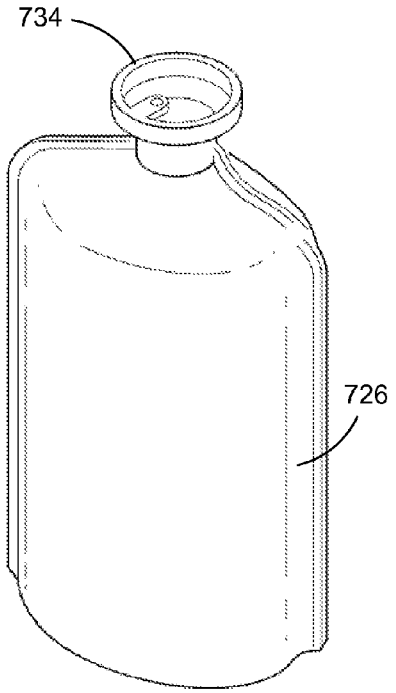
FIG. 8B is a perspective view of the collapsible pouch of FIG. 8A.
Figure 9A:
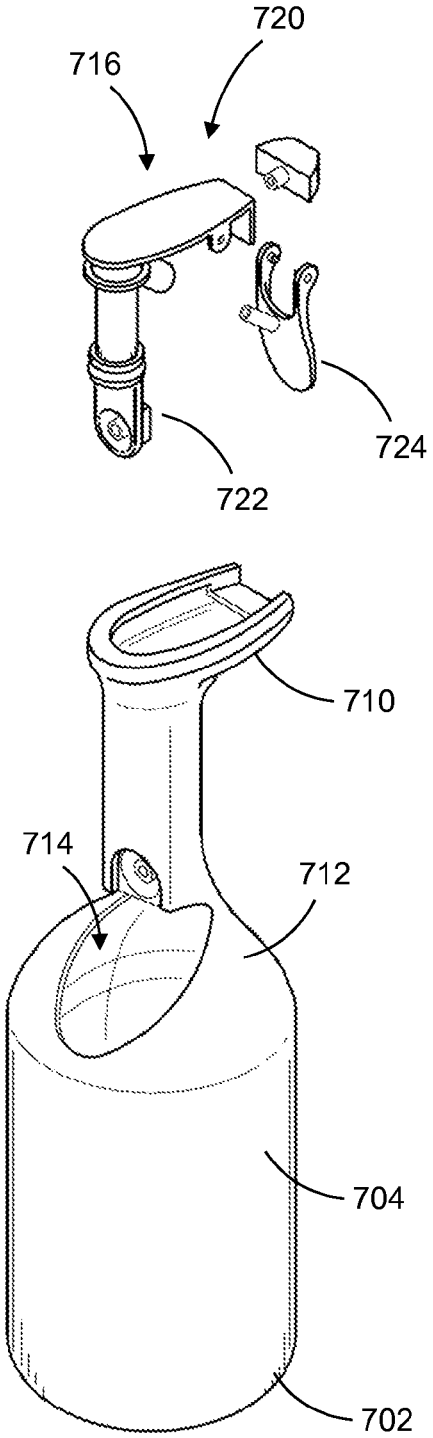
FIG. 9A is a perspective view of a container frame and components of a mechanical pump mechanism, according to at least one other embodiment.
Figure 9B:
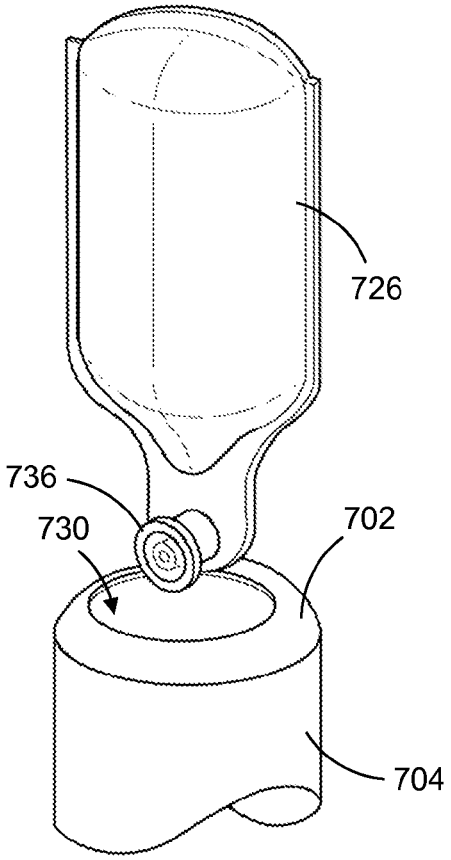
FIG. 9B is a perspective view of a collapsible pouch being loaded into the container frame of FIG. 9A.
Figure 10A:
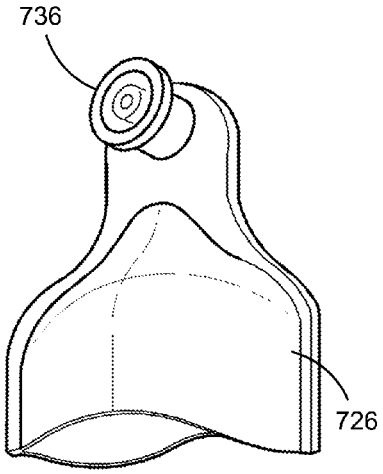
FIG. 10A is a perspective view of an upper portion of a collapsible pouch according to at least one embodiment.
Figure 10B:
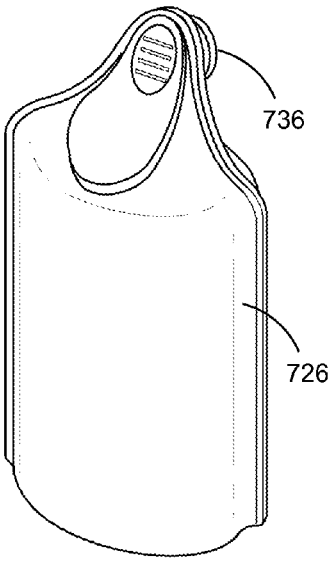
FIG. 10B is another perspective view of the collapsible pouch of FIG. 10A.
Figure 10C:
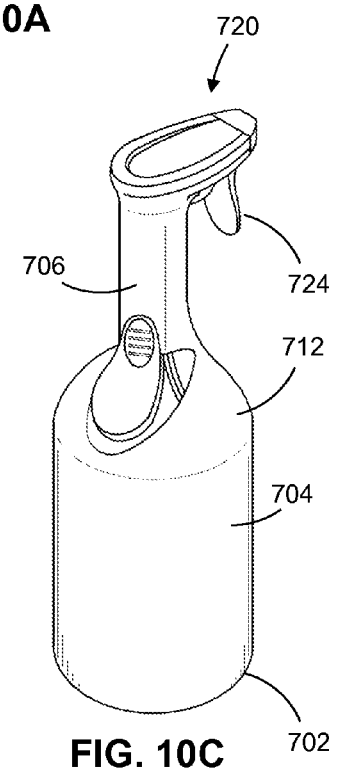
FIG. 10C is a perspective view of the collapsible pouch of FIGS. 10A and 10B loaded for use into a container frame to form a spray apparatus according to at least one embodiment.

Various embodiments of fluid connectors are illustrated with the pouch 726 in FIGS. 7B, 8B, 9B, and 10A-B. In FIG. 7B, a connector 732 having a tab structure and breakable seal is shown. In FIG. 8B, a connector 734 having a funnel structure is shown. In FIGS. 9B and 10A-B, a connector 736 having a central tube end and concentric gasket is shown. In each embodiment, a draw tube may extend within the pouch 726 from the connector of the pouch. The draw tube, permanently fixed to the connector of the pouch, makes a fluid connection with the fluid connector 722 of the spray head 720 when the pouch docks with the spray head. Docking makes a mechanical connection that provides both a fluid seal and weight support of the pouch and its contents. In use, the shoulder 712 is flexible, thus defining a pivoting junction of the upper neck 706 and circumferential wall 704 and permitting hinging of the upper neck 706 and spray head 720 allowing a user to direct dispensed solution as desired, for example, in cleaning chores and in watering plants, while the lower volumetric portion of the pouch remains perpendicular to the ground plane. Axial movement, for example in a vertical direction, of the volumetric portion of the pouch is freely accommodated by the circumferential wall 704 further permitting hinging of the upper neck 706 and spray head 720.

Figure 11A:
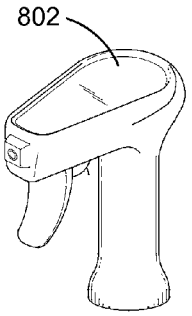
FIG. 11A is a perspective view of a spray mechanism according to at least one embodiment.
Figure 11B:
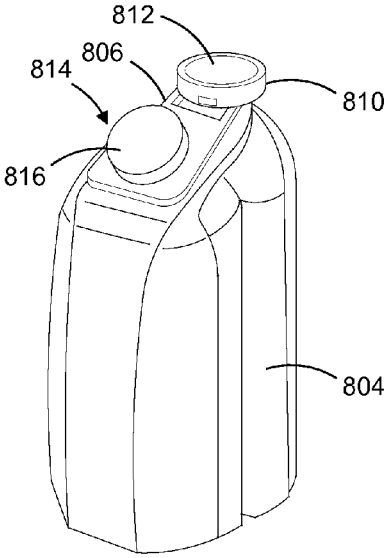
FIG. 11B is a perspective view of a liquid containment vessel according to at least one embodiment.

A liquid containment vessel 800 that can be attached (FIG. 11C) to a spray mechanism 802 (FIG. 11A) is shown in FIG. 11B. The vessel 800 has a main container body 804 constructed of self-supporting fiberboard that is laminated to provide a liquid impermeable free standing structure in the expanded configuration of FIGS. 11B and 11C. The body 804 has flexure zones such as creases to facilitate predetermined folds by which a reduced configuration toward a single vertical plane is achieved, for example by manual pressure applied perpendicular to the vertical plane in the grasp of a user. See the reduced configuration of the body 904 of the vessel 900 in FIG. 12B for an example of reduction toward a single vertical plane.

Figure 11C:
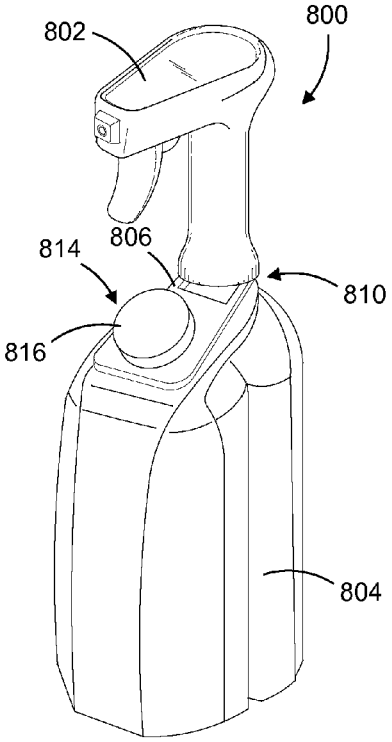
FIG. 11C is a perspective view of the spray mechanism of FIG. 11A attached to the liquid containment vessel of FIG. 11B.

The body 804 (FIGS. 11A-11B) extends upward from a lower base to an upper flexible tab 806 on which a flange 810 is mounted for attachment of a spray mechanism 802. The flexible tab 806 is capable of hinging movement relative to the uppermost region of the body 804 allowing the spray mechanism 802 to change angles while the lower liquid containment portion of the body remains upright due to gravity. The mounting flange 810 has a seal 812 that is punctured or otherwise broken when the spray mechanism is engaged with the flange 810. The vessel has an internal siphon tube permanently affixed to the mounting flange 810 such that the siphon tube always remains in the body 804 extending toward the base to assure fluid connection with the spray mechanism even as liquid content of the body 804 dwindles. As shown in FIGS. 11B-11C, a refill spout 814 is mounted on the upper flexible tab 806. A cap 816 sealingly engages the spout 814 for maintaining closure of the vessel 800 when desired.

Figure 12A:
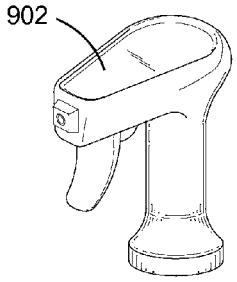
FIG. 12A is a perspective view of a spray mechanism according to at least one embodiment.
Figure 12C:
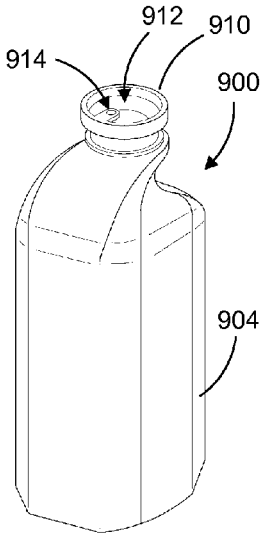
FIG. 12C is a perspective view of the liquid containment vessel of FIG. 12B in an expanded configuration.
Figure 12B:
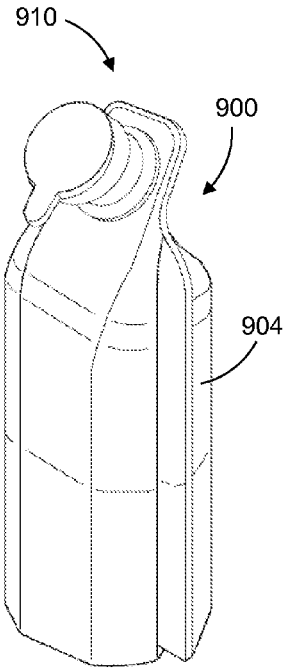
FIG. 12B is a perspective view of a liquid containment vessel according to at least one embodiment in a reduced configuration.
Figure 12D:
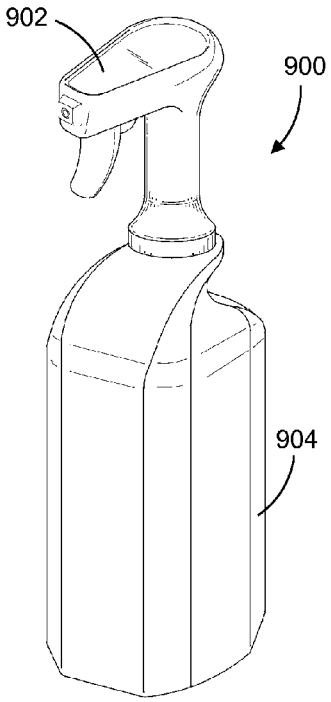
FIG. 12D is a perspective view of the spray mechanism of FIG. 12A attached to the liquid containment vessel of FIG. 12C.

A liquid containment vessel 900 that can be attached (FIG. 12D) to a spray mechanism 902 (FIG. 12A) is shown in FIG. 12B in a reduced configuration and in FIG. 12C in an expanded configuration. The vessel 900 has a main container body 904 constructed of self-supporting fiberboard that is laminated to provide a liquid impermeable free standing structure in the expanded configuration of FIG. 12C. The vessel 900 optionally includes by reference features from the above descriptions with regard to FIGS. 11B-11C.

The mounting flange 910 of FIG. 12C for mounting the spray head 902 has two openings. The first opening 912 is for filling/refilling the container body 904. The second opening 914 retains the uppermost end of a draw tube. When the spray head 902 is attached to the mounting flange 910 (FIG. 12D), the filling/refilling opening 912 (FIG. 12C) is sealed and connection is established between the draw tube and the spray head 902. Subsequent actuation of the operable trigger of the spray head causes dispensation of fluid from within the vessel through the spray head by way of the draw tube.

Figure 13A:
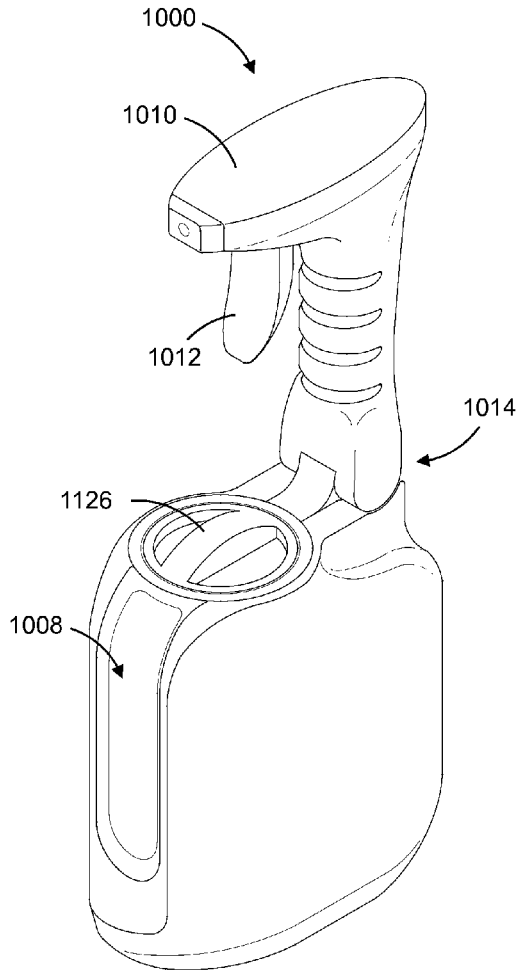
FIG. 13A is a perspective view of a spray bottle according to at least one embodiment in which mutually engaging components of a pivotal hinge are integral respective parts of a container body and neck.
Figure 13B:
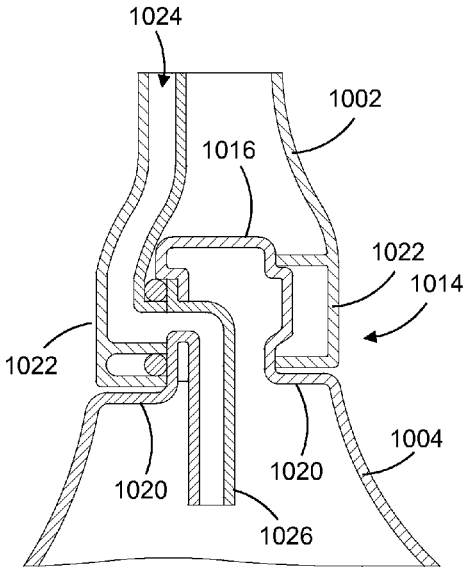
FIG. 13B is a cross-sectional view of the pivotal hinge of the spray bottle of FIG. 13A.

In FIGS. 13A and 13B, a spray bottle 1000 includes an upper neck 1002 pivotally attached to a lower body 1004 to permit selectable orientation of the neck 1002 according to needs or preferences of a user. The neck extends from the body 1004 to a hand-held spray head 1010 that includes an operable trigger 1012 and an internal pump mechanism. Actuation of the operable trigger 1012 causes dispensation of fluid within the body 1004 through the spray head 1010 by way of internal conduits and/or channels, embodiments of which are illustrated for example in FIG. 13B. In the illustrated embodiments of FIG. 13A, respective mutually engaging components of a pivotal hinge 1014 are integral parts of the body 1004 and neck 1002. The body 1004 (FIG. 13A) includes a forward-opening recess 1008 that at least partially receives the spray head 1010 and/or trigger 1012 when the neck is pivoted forwardly around the pivotal hinge 1014 toward the body 1004 to assume a folded-down configuration minimizing the height of the spray bottle 1000 for space-efficient storage and stability purposes.

As shown in FIG. 13B, the upper end of the body 1004 terminates as a protrusion 1016 centrally located between shoulders 1020 above which the protrusion 1016 extends. The lower end of the neck 1002 terminates as a spaced pair of braces 1022 defining a slot therebetween that receives the protrusion 1016 in a rotatable engagement. With the body 1004 in a generally vertical orientation and the protrusion 1016 extending upwardly, the braces 1022 and neck 1002 are rotatable relative to the body 1004 about a horizontal axis. A channel 1024 molded into the neck provides fluid communication between the pivotal hinge 1014 and spray head 1010 (FIG. 13A). At the pivotal hinge 1014, the channel 1024 (FIG. 13B) has a horizontal segment along the horizontal axis in one of the braces 1022. The protrusion 1016 is generally hollow and includes a side port opening horizontally in alignment with the horizontal segment of the channel 1024. A siphon tube 1026 within the body 1004 provides fluid communication between the pivotal hinge 1014 and a lower portion of the body 1004 to make contact with liquid within the body. The upper end of the siphon tube 1026 includes a right-angle bend and a horizontal section that terminates in an annular flange disposed generally in a vertical plane. The horizontal section of the siphon tube 1026 passes through the side port of the protrusion 1016 in alignment and fluid connection with the horizontal segment of the channel 1024. The annular flange of the siphon tube 1026 is trapped between the protrusion 1016 and brace 1022 as shown in FIG. 13B, sealing against the brace 1022 when the protrusion is snapped into place between the braces during assembly.

Figure 16A:
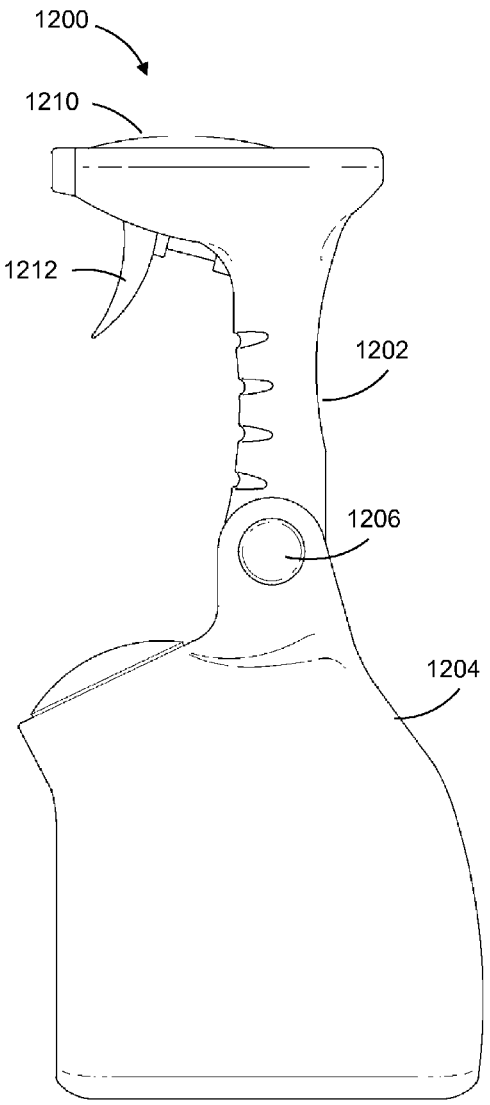
FIG. 16A is an elevation view of a spray bottle according to at least one embodiment in which an upper neck is pivotally attached to a lower body to permit selectable orientation of the neck.
Figure 16B:
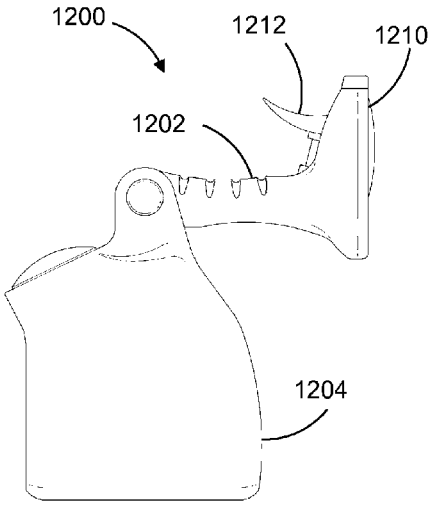
FIG. 16B is an elevation view of the spray bottle of FIG. 16A with the neck in a rearwardly pivoted position.
Figure 16C:
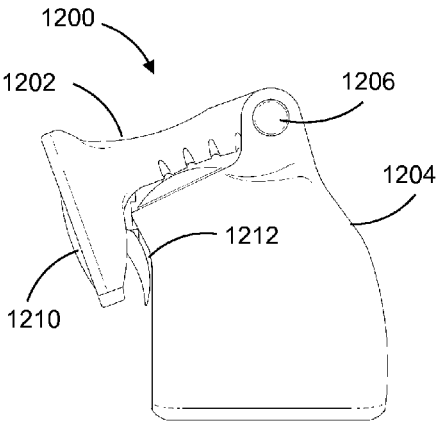
FIG. 16C is an elevation view of the spray bottle of FIG. 16A with the trigger swung forward and neck pivoted toward the body.

Fluid connection with liquid resources in the body 1004 is provided to the spray head 1010 vertically from a lower portion of the body 1004 through the siphon tube 1026 to the pivotal hinge 1014, horizontally through the pivotal hinge via the horizontal section of the siphon tube 1026 and horizontal segment of the channel 1024, and to the spray head 1010 via the channel 1024 along the interior of the neck 1022 in any rotational disposition of the neck and spray head relative to the body, similarly as in the example shown in FIGS. 16A-16C. As the braces 102 (FIGS. 13A-13B) are rotated about the pivotal hinge 1014, the annular flange of the siphon tube 1026, which is fixed relative to the protrusion 1016 and body 1004, maintains a seal with corresponding brace 1022 even as the brace rotates. An O-ring or other resilient sealing gasket may be positioned in the pivotal hinge 1014 area.

Figure 14:
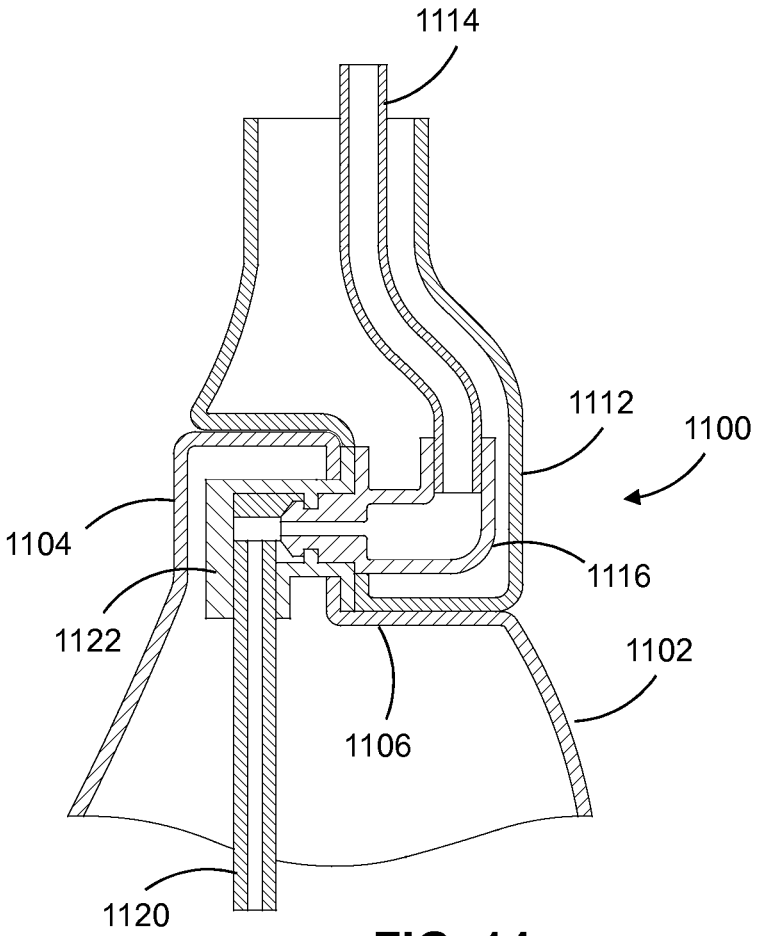
FIG. 14 is a cross-sectional view of an alternative embodiment of pivotal hinge.

An alternative embodiment of a pivotal hinge 1100 is shown in FIG. 14. The upper end of a container body 1102 terminates as a laterally located protrusion 1104 extending above a single shoulder 1106. The lower end of a neck 1110 terminates as a single lateral brace 1112 that rotationally engages the protrusion 1104. With the body 1102 in a generally vertical orientation and the protrusion 1104 extending upwardly, the brace 1112 and neck 1110 are rotatable relative to the body 1102 about a horizontal axis.

An upper tube 1114 extending into the neck provides fluid communication between the pivotal hinge 1100 and a dispensation element such as a spray head. At the pivotal hinge 1100, the upper tube 1114 engages a neck-fixed first fitting 1116 retained by the neck at the brace 1112. The first fitting 1116 includes a right-angle bend and a horizontal section that terminates in an annular flange disposed generally in a vertical plane. A lower tube 1120 within the body 1102 provides fluid communication between the pivotal hinge 1100 and a lower portion of the body 1102 to make contact with liquid within the body. The upper end of the lower tube 1120 engages a body-fixed second fitting 1122 retained by the body at the protrusion 1104. The second fitting 1122 includes a right-angle bend and a horizontal section that terminates in an annular flange disposed generally in a vertical plane. The annular flanges of the first fitting 1116 and second fitting 1122 contact each other establishing a fluid seal in any rotational position of the neck 1110 relative to the body 1102. The fittings engage in male-female relation pivotally attaching the neck 1110 to the body.

Figure 15:
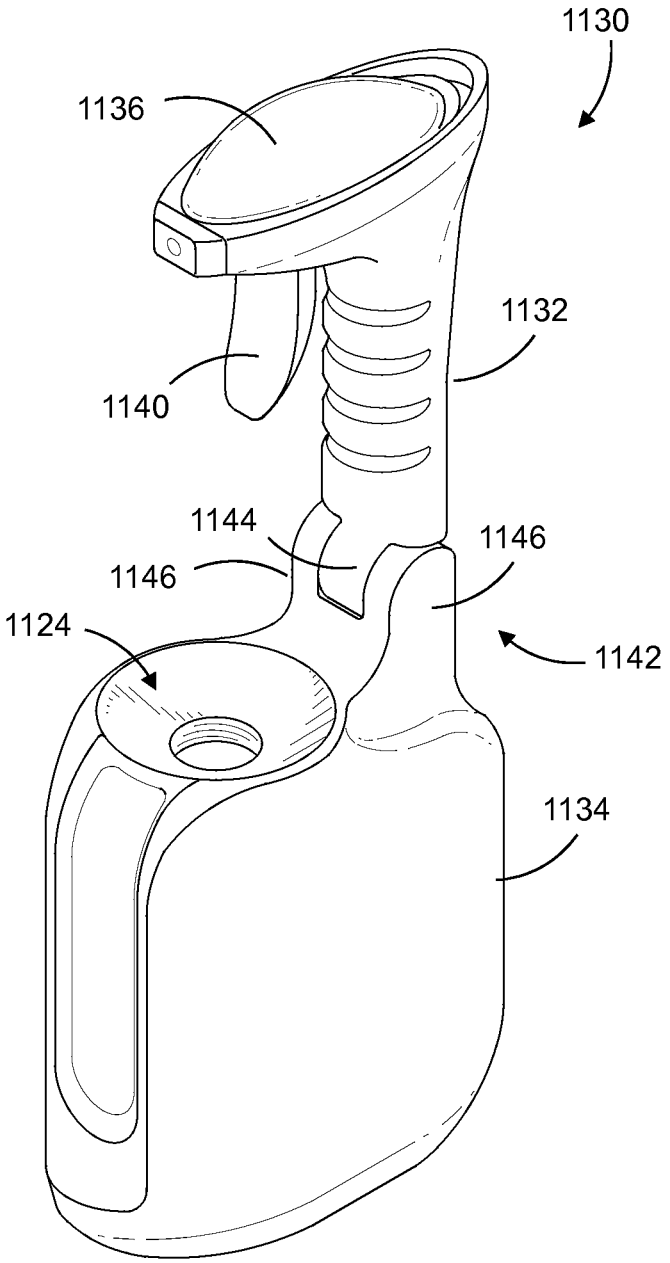
FIG. 15 is a perspective view of a spray bottle according to at least one embodiment in which mutually engaging components of a pivotal hinge are integral respective parts of a container body and neck.

In FIG. 15, a spray bottle 1130 includes an upper neck 1132 pivotally attached to a lower body 1134 to permit selectable orientation of the neck 1132 according to needs or preferences of a user. The neck extends from the body 1134 to a hand-held spray head 1136 that includes an operable trigger 1140 and an internal pump mechanism. In the illustrated embodiment of FIG. 15, respective mutually engaging components of a pivotal hinge 1142 are integral parts of the body 1134 and neck 1132. The lower end of the neck 1132 terminates as a central protrusion 1144. The upper end of the body 1134 terminates as a spaced pair of braces 1146 defining a slot therebetween that receives the protrusion 1144 in a rotatable engagement. In other respects, the spray bottle 1130 of FIG. 15 bears similarities to the spray bottle 1000 of FIG. 13A.

In both embodiments (FIG. 13A, 15) the container body includes a funnel-shaped opening 1124 (FIG. 15) for filling and refilling purposes. A cap 1126 (FIG. 13A) engages the container body to seal the opening 1124 when in use or storage. The cap 1126 may be engaged by threads, a quarter-turn engagement, or a snap engagement above or below the funneling surface. Advantageously, refilling of the container body through the opening 1124 can be accomplished without interaction or tampering with the internal components such as the tube 1026 (FIG. 13B) or the lower tube 1120 and body-fixed second fitting 1122 (FIG. 14).

In FIGS. 16A-16C, a spray bottle 1200 includes an upper neck 1202 pivotally attached to a lower body 1204 to permit selectable orientation of the neck 1202 about a pivotal hinge 1206 according to needs or preferences of a user. The neck extends from the body 1204 to a hand-held spray head 1210 that includes an operable trigger 1212 and an internal pump mechanism. Actuation of the operable trigger 1212 causes dispensation of fluid within the body 1204 through the spray head 1210 by way of one or more internal conduits such as tubes and/or channels. In the illustrated embodiment of the spray bottle 1200, respective mutually engaging components of a pivotal hinge 1206 are integral parts of the body 1204 and neck 1202.

The operable trigger 1212 (FIG. 13A) drives the internal pump mechanism to dispense solution through the spray head 1210 from the container body upon pressing of the trigger toward the neck 1202. The operable trigger 1212 is pivotally or movably mounted on the spray head 1210 to: engage the pump mechanism upon trigger rotation or movement in a first direction; and to permit swinging away of the trigger from the neck 1202 by rotation or movement in a second direction generally opposite the first direction. When the trigger 1212 is swung away from the neck 1202, as shown in FIG. 16C, and the neck is folded down toward the body 1204, a forward portion of the body is positioned between the swung-away trigger 1212 and the neck 1202. In this configuration (FIG. 16C), overall height of the spray bottle 1200 is minimized for storage or stability purposes. Advantageously, actuation of the operable trigger 1212 by rotation or movement toward the neck 1202 is blocked by the body 1204 and thus accidental discharge of solution from the spray head 1210 is prevented in this configuration (FIG. 16C). In the illustrated embodiment, minimization of the height of the spray bottle 1200 and blocking of the trigger 1212 is accomplished in FIG. 16C by forward positioning (swung-away from the neck) of the trigger and downward positioning (folded down toward the body) of the neck 1202 without compromising the storage volume capacity of the body 1204.

The internal hollowed and/or channeled features of FIGS. 13A-B, 14-15, and 16A-16C can be integrally molded into bottle components by means of pressurized gas being introduced into a mold during processing, thereby forcing plastic towards mold walls and forming channels or other hollow features in a gas assist manufacturing process. A refill opening such as the funnel-shaped opening 1124 in FIG. 15 can be used to access internal areas of manufactured components for the installation of, for example, the body-fixed fitting 1122 (FIG. 14). In at least one embodiment, the first fitting 1116 and/or second fitting 1122 are molded parts to satisfy tolerance requirements for a sealing pivotal hinge. The fittings are spin welded into their respective positions, thus joining molded parts (1116, 1122) with gas-assist manufactured parts (1102, 1104).

While the embodiments have been described in connection with the preferred embodiments of the various figures, it is to be understood that other similar embodiments may be used or modifications and additions may be made to the described embodiments for performing the same function without deviating therefrom. Therefore, the disclosed embodiments should not be limited to any single embodiment, but rather should be construed in breadth and scope in accordance with the appended claims.

What is claimed is:

1. A vessel comprising:

a closed wall having open opposing ends, the closed wall surrounding a variable interior volume defined within the closed wall between the open opposing ends, the closed wall having a first wall portion, a second wall portion, and a flexure zone connecting the first wall portion and the second wall portion, the closed wall having a volumetrically expanded configuration and a volumetrically reduced configuration in which the first wall portion and the second wall portion of the closed wall are brought together relative to the expanded configuration by flexing of the flexure zone;

a flexible fluid impermeable pouch at least partially within the variable interior volume of the closed wall, the flexible fluid impermeable pouch having an internal reservoir space for containing a liquid, the internal reservoir space having a relatively greater volume when the closed wall is in the expanded configuration and a relatively lesser volume when the closed wall is in the reduced configuration; and a spray head connected to the flexible fluid impermeable pouch and having an operable trigger that upon actuation causes dispensation of liquid from the internal reservoir space of the flexible fluid impermeable pouch;

wherein the spray head is movable in both the expanded and reduced configuration of the closed wall to at least one deployed position outside of the variable interior volume of the closed wall by expansion of the flexible fluid impermeable pouch, and the spray head is movable to at least one stowed position at least partially within the variable interior volume of the closed wall by at least partial collapse of the flexible fluid impermeable pouch.

2. The vessel of claim 1, wherein the flexure zone comprises a crease around which the first wall portion and second wall portion of the closed wall are folded toward each other in the reduced configuration relative to the expanded configuration.

3. The vessel of claim 2 wherein, in the reduced configuration, the first wall portion and the second wall portion form a flap.

4. The vessel of claim 3 wherein, the vessel comprises at least one fixing element attached to the closed wall, and wherein, in the reduced configuration, the flap is releasably maintained as overlapping a neighboring portion of the closed wall by the fixing element.

5. The vessel of claim 3 wherein, in the reduced configuration, the flap and the overlapped neighboring portion form a Z-fold.

6. The vessel of claim 1 wherein, the closed wall comprises:

a first flexible crease that defines the flexure zone connecting the first wall portion and the second wall portion, and a second flexible crease parallel to the first flexible crease connecting the second wall portion to a neighboring wall portion of the closed wall;

wherein the closed wall assumes a partially coiled configuration by folding of the first flexible crease bringing the first wall portion and second wall portion together forming a flap, and folding the second flexible crease bringing together the second wall portion and the neighboring wall portion such that the flap overlaps the neighboring wall portion.

7. The vessel of claim 1, wherein the vessel comprises at least one fixing element attached to the closed wall, and, in the reduced configuration, the flap is releasably maintained as overlapping a neighboring portion of the closed wall by the fixing element, the fixing element comprising adhesive.

8. The vessel of claim 1, further comprising a soluble product within internal reservoir space of the flexible fluid impermeable pouch in a concentrated form, the soluble product prescribed for use in a diluted form by addition of a solvent to approximately fill the internal reservoir space of the flexible fluid impermeable pouch in the expanded configuration of the closed wall.

9. The vessel of claim 1, further comprising indicia hidden from view in the reduced configuration and exposed for view in the expanded configuration.

10. The vessel of claim 1, further comprising a tube having a first end connected to the spray head and a second end opposite the first end, wherein:

the flexible fluid impermeable pouch has an upper end connected to the spray head and a base opposite the upper end; and the second end of the tube is attached to the base of the flexible fluid impermeable pouch to maintain fluid connection of the tube with the liquid in the internal reservoir space of the flexible fluid impermeable pouch.

* * * * *